US009611085B2

(12) United States Patent
Mangold et al.

(10) Patent No.: US 9,611,085 B2
(45) Date of Patent: Apr. 4, 2017

(54) ARRANGEMENT OF A PLURALITY OF MOIST PADS IN A PACKAGING CONTAINER FOR DISPENSING TO THE END USER

(71) Applicant: CMC Consumer Medical Care GmbH, Sontheim an der Brenz (DE)

(72) Inventors: Rainer Mangold, Herbrechtingen (DE); Angela Roempp, Duernau (DE)

(73) Assignee: CMC Consumer Medical Care GmbH, Sontheim an der Brenz (DE)

( * ) Notice: Subject to any disclaimer, the term of this patent is extended or adjusted under 35 U.S.C. 154(b) by 0 days.

(21) Appl. No.: 14/408,965

(22) PCT Filed: Apr. 5, 2013

(86) PCT No.: PCT/EP2013/057168
§ 371 (c)(1),
(2) Date: Dec. 18, 2014

(87) PCT Pub. No.: WO2014/005731
PCT Pub. Date: Jan. 9, 2014

(65) Prior Publication Data

US 2015/0144648 A1 May 28, 2015

(30) Foreign Application Priority Data

Jul. 4, 2012 (EP) ..... 12174942

(51) Int. Cl.
*B65D 83/08* (2006.01)
*A47K 10/42* (2006.01)

(52) U.S. Cl.
CPC ..... *B65D 83/0894* (2013.01); *A47K 10/421* (2013.01)

(58) Field of Classification Search
CPC ..... A47K 10/421; B65D 75/5855; B65D 83/0805; B65D 83/0894
See application file for complete search history.

(56) References Cited

U.S. PATENT DOCUMENTS

| | | | | |
|---|---|---|---|---|
| 5,007,558 | A * | 4/1991 | Allen et al. | 221/48 |
| 5,738,212 | A * | 4/1998 | Pollard et al. | 206/362 |
| 6,102,247 | A * | 8/2000 | Crawford | 221/61 |
| 6,612,437 | B1 * | 9/2003 | Klemets | 206/445 |
| 2004/0245139 | A1 * | 12/2004 | Mangold et al. | 206/494 |
| 2013/0089643 | A1 * | 4/2013 | Chapman | 426/119 |

FOREIGN PATENT DOCUMENTS

| | | |
|---|---|---|
| DE | 10 2006 020 926 | 11/2007 |
| EP | 1 440 019 | 4/2005 |

* cited by examiner

*Primary Examiner* — Gene Crawford
*Assistant Examiner* — Kevin L Randall, Jr.
(74) *Attorney, Agent, or Firm* — Paul Vincent

(57) ABSTRACT

A plurality of moist pads are arranged in two stacks (36,40) such that the pads (32,34) of the stacks (36,40) overlap in a partial region in such a manner that a pad (24) of a second stack (40) protrudes into the partial region (74) between two pads (32) of a first stack (36). The pads (32) of the first stack (36) and the pads (34) of the second stack (40) each have a material cut-out (50) at the edge in order to form a gripping aid, and the pads (32) of the first stack (36) and of the second stack (40) are each oriented in such a manner that the material cut-outs (50) of the pads (32) of the first stack and the material cut-outs of the pads of the second stack jointly define the partial region.

27 Claims, 6 Drawing Sheets

ARRANGEMENT OF A PLURALITY OF MOIST PADS IN A PACKAGING CONTAINER FOR DISPENSING TO THE END USER

This application is the national stage of PCT/EP2013/057168 filed on Apr. 5, 2013 and claims Paris Convention Priority from EP 12 174 942.8 filed Jul. 4, 2012.

BACKGROUND OF THE INVENTION

The invention concerns an arrangement of a plurality of moist pads in a packaging container for dispensing to the end user, wherein the pads are arranged in two stacks such that the pads of the stacks overlap in a partial region in such a manner that a pad of a second stack protrudes into the partial region between two pads of a first stack.

Such an arrangement is known from EP 1 440 019 B1 and from DE 10 2006 020 926 A1. The alternate mutually overlapping arrangement of the pads of different stacks permits easy removal of an individual pad from the packaging container as compared with an arrangement of pads in only one stack.

The object of this invention is to create an arrangement that permits particularly easy removal of an individual pad from the packaging container.

SUMMARY OF THE INVENTION

This object is inventively achieved in a packaging container of the type stated above in that the pads of the first stack and the pads of the second stack each have a material cut-out at the edge in order to form a gripping aid, and that the pads of the first stack and the pads of the second stack are each oriented in such a manner that, at least in portions, the material cut-outs of the pads of the first stack and the material cut-outs of the pads of the second stack jointly define the partial region.

Depending on the implementation of the material cut-out and the disposition of the pads in the two stacks with respect to one another, this so-called partial region, in which the pads of the stack inventively overlap, can be divided into two parts and, in particular, comprise a first overlap section and a second overlap section, and, in particular, be spaced by an interposed free area (that is, by a material-free interstice that has a surface extending parallel to the extension plane of one pad).

The pads of different stacks are disposed such that they overlap in an alternating manner. Only one single pad of a second stack preferably protrudes into the partial region of the overlap between two pads of a first stack. Alternatively for this purpose, a plurality of pads, preferably two pads, in particular no more than three pads, of one stack protrude into the partial region of overlap between two pads of another stack, so that, in each case, two or three pads of different stacks are disposed overlapping in an alternating manner.

According to the invention, the pads have a material cut-out at the edge that is used as a gripping aid. Such a gripping aid can, for example, be formed by a recess in the contour of a pad. By the disposition of such material cut-outs at the edge in the partial region, in which pads of different stacks overlap, a compact gripping region is formed, in which gripping of one pad at a time is especially conveniently provided for.

In particular, the pads of different stacks are oriented with respect to each other at least substantially with mirror symmetry. In this way, a symmetrical arrangement with the smallest possible gripping region is formed.

A further simplification of the removal of pads from the packaging container results if the material cut-outs of the pads of different stacks are oriented in opposite directions with respect one another, for example, both pointing toward the partial region (the material cut-outs face the packaging center of the packaging container) or both facing away from the partial region. (The material cut-outs face a periphery of the packaging container.) This results in a minimum distance of the edges of the material cut-outs of the pads of different stacks and therefore reduces the size of the gripping region required to grip the pads of different stacks.

The edge of the pads preferably have, with the exception of the material cut-out, a geometric basic shape, wherein the basic shape is preferably circular, oval, or polygonal. The material cut-out is, in particular, partially circular or partially elliptical, so that the edge of the material cut-out can be especially simply gripped with one finger from the front or behind.

The edge of the pad with the exception of the material cut-out preferably has a circular basic shape, preferably with a radius assigned to the basic shape between 23 and 40 mm, further preferably between 28 and 38 mm, further preferably between 32 and 38 mm, further, in particular, with a radius of 35 mm.

Due to the material cut-out at the edge, the pads have a minimum diameter that differs from the radius of the basic shape. The minimum diameter is measured using an imaginary line departing from the apex of the material cut-out via the center of the basic shape leading to the intersection point with the edge of the pad opposite the material cut-out. The minimum diameter, in particular, in the case of a circular basic shape of the pad, is preferably between 25 and 73 mm, further preferably between 40 and 63 mm, further preferably between 50 and 58 mm.

The pad having the material cut-out, in particular, the pad with a circular basic shape, further preferably has a pad area between 13 and 45 $cm^2$, in particular, between 18 and 37 $cm^2$, further in particular, between 20 and 25 $cm^2$.

It is further preferred if the pads of both stacks are identical in terms of their material and/or their shape (in particular, the basic shape and/or the shape of the material cut-out) and/or their dimensions.

According to one embodiment of the invention, the edges of each pad extend free of folds along a section outside the material cut-out and/or along the material cut-out. In this way, pads can be provided in an especially conveniently usable way.

It is further preferred if a transition, preferably both transitions, of the edges of each pad between a section outside the material cut-out and the material cut-out is or are free of folds. In this way, an edge is provided that is especially suitable for convenient gripping contact in the region of the transitions as well.

"Free of folds" is understood to mean that there is no abrupt change within the edge of the pads and/or along the material cut-out but, in particular, changes of direction caused by differing radii transition into one another so that, for example, rounded corners result.

According to the invention, the edge of the material cut-out differs from the basic shape of the pad, preferably, having the shape of a partially circular or partially elliptical recess. The shape of the border limiting the recess is preferably defined by a radius. The radius of the recess can preferably correspond to the radius of the circular basic shape of the pad, wherein the radius of the basic shape is preferably between 23 and 40 mm, further preferably between 28 and 38 mm, further preferably between 32 and 38 mm, further preferably 35 mm. Alternatively, the radius of the recess can be smaller than the radius of the basic shape of the pad. The radius of the recess is preferably between 10 and 35 mm.

The border of the recess transitions, with reference to the direction of the minimum diameter defined above, into the basic shape in transitions disposed opposite each other, in particular, free of folds.

The border of the transitions preferably has a radius that is smaller than the radius defining the basic shape of the pad. The radius in the transitions is preferably between 5 and 15 mm, further preferably 10 mm.

According to one embodiment of the invention, the pads each have an edge differing from a straight-lined shape (in particular, a zig-zag or wavy edge), wherein each material cut-out at the edge extends inwardly beyond the edge differing from the straight-lined shape.

It is especially preferred if each pad has precisely one material cut-out at the edge serving as a gripping aid. This ensures both convenient removal of a pad and provision of the greatest possible quantity of pad material.

According to one embodiment of the invention, the total area jointly limited by two overlapping pads of different stacks has no discontinuities. This has the advantage that the packaging volume provided by a certain packaging container can be especially well used.

According to a further embodiment of the invention, a total area jointly limited by one of two overlapping pads of different stacks has a free area that is limited by at least part of the borders of the material cut-outs at the edge of the two pads. Such a free area reduces the useful volume with reference to a certain packaging container but at the same time further improves the convenience of pad removal because a space extending perpendicular to the free area can be used to introduce a finger and therefore to remove a pad in a particularly convenient manner.

The inventive arrangement enables especially good use of the volume of a packaging container. This is ensured, in particular, if the packaging container has a basic area for setting up the stack, if the pads have a pad area enclosed by the edge of a pad, and if the ratio of basic area to pad area is between 1.30 and 2.00, preferably between 1.50 and 1.80.

In particular, the packaging container has a basic area between 28 and 76 $cm^2$, further, in particular, between 35 and 55 $cm^2$.

An especially large useful volume arises even if two overlapping pads of different stacks jointly occupy one stack area, if the two pads each have a pad area enclosed by the edge of the pad, and if the ratio of stack area to pad area is between 1.10 and 1.80, preferably between 1.20 and 1.70.

Convenient removal with a high useful volume also results if the partial region in which pads of the stack overlap have an overlap area, if the pads each have a pad area enclosed by the edge of the pad, and if the ratio of overlap area to pad area is between 0.25 and 0.90, preferably between 0.28 and 0.83, in particular, between 0.40 and 0.67.

Both convenient removal and a high useful volume can be ensured if the partial region in which the pads of the stack overlap, has an overlap area, if the packaging container has a basic area for setting up the stack, and the ratio of overlap area to basic area is between 0.12 and 0.83, preferably between 0.16 and 0.50.

Special advantages arise if the packaging container has a wall, in particular, a wall on the cover side, in which a preferably detachably lockable removal opening having a removal opening area for removal of one pad at a time is provided. Such a removal opening makes it possible to influence how conveniently a pad can be removed from the packaging container and to what extent mechanical protection and/or protection against drying of moist pads is to be implemented.

It is possible that the whole wall of the packaging container comprising the removal opening can be removed. This is the case, for example, with a cover that, in the case of mutually parallel sidewalls of a packaging container, at least substantially has the same area as a basic area of the packaging container that is used to set up the two stacks. It is especially preferred, however, if the removal opening area is smaller than the basic area for setting up the stack. It is especially preferred if the ratio of removal opening area to basic area is between 0.06 and 0.20, preferably between 0.10 and 0.18, in particular between 0.10 and 0.16. These stated ratios entail the removal opening area being relatively small with respect to the basic area, so that especially good protection against drying out of the pads can be provided. Because of the inventive arrangement of the material cut-outs in the overlapping partial region, convenient removal of the pads overlapping in an alternating manner is ensured despite the relatively small removal opening.

The removal opening can have any shape. In particular, the removal opening can have a first longitudinal extent and a relatively shorter second longitudinal extent perpendicular to the former. The removal opening can have a substantially elongated shape, for example, a rectangular shape or an elongated hole shape or a shape that combines these shapes. The removal opening can have a necked, in particular, symmetrically constituted profile to reduce the size of the removal opening area of the removal opening.

The removal opening is preferably disposed centrally in the wall of the packaging container containing the removal opening.

It is further preferred if the removal opening is disposed in the wall of the packaging container such that the first longer longitudinal extent of the removal opening is disposed in the direction of the longer extent of the removal opening (for example, the wall of the packaging container in which the removal opening is provided).

The removal opening has, in particular, a removal opening area between 3 and 10 $cm^2$, further, in particular, between 3 and 8 $cm^2$, further, in particular, between 3 and 7 $cm^2$. In particular, the removal opening has an elongated shape, with the first longer longitudinal extent between 20 and 50 mm, in particular, between 25 and 45 mm, further, in particular, between 30 and 40 mm.

Especially good protection from drying out of moist pads results if the removal opening is positioned and dimensioned such that only the following are accessible through the removal opening: a partial section of the partial region, in which the pads of the stacks overlap; a material cut-out of a pad of the first stack or a part thereof; after removal of such a pad of the first stack, a material cut-out of a pad of the second stack or part thereof.

A further improvement results if the partial section of the partial region in which the pads of the stacks overlap has a partial section area, and if the ratio of partial section area to removal opening area is between 0.12 and 0.90, preferably between 0.20 and 0.90, in particular, between 0.33 and 0.90.

If a total area limited by two overlapping pads of different stacks has a free area, which is limited by at least part of the limits of the material cut-outs at the edge of the two pads, it is preferred if the removal opening is positioned and dimensioned such that only the following are accessible through the removal opening: the free area or part of the free area; a material cut-out of a pad of the first stack or part thereof; after removal of such a pad of the first stack, a material cut-out of a pad of the second stack or part thereof. This enables convenient access of a finger into a space that is adjacent and perpendicular to the free area and removal of a pad of the first stack, followed by removal of a pad of the second stack, followed again by removal of a pad of the first stack, etc.

Both especially convenient removal of the pads and a smaller removal opening results if the free area accessible through the removal opening or the part of the free area accessible through the removal opening has an access free area, and if the ratio of access free area to removal opening area is between 0.16 and 0.64.

Finally, both convenient removal of a pad and a smaller removal opening results if the distance measured perpendicularly to the removal direction from a border of the removal opening to the closest border of the material cut-out at the edge of a pad is between 5 mm and 16 mm, preferably between 5 mm and 12 mm, in particular, between 5 mm and 8 mm.

It also proves advantageous if the packaging container is made of polymer materials or includes these, such as, in particular, thermoplastics, such as polyethylene, polypropylene, polyester, and/or polystyrene.

The packaging container has a packaging basic body with a basic area for setting up the stacks and a side wall.

The packaging basic body is advantageously manufactured from the polymer materials in a deep drawing process. Such a packaging basic body as a deep-drawn part can be manufactured easily and inexpensively in this way, and also permits many design options. Further, a wall on the cover side is preferably mounted on the packaging basic body, in particular, by means of nondetachable adhesive, sealed, or welded connections.

The pads included in the packaging container can be made of any material. The pads can preferably be made of or include nonwoven structures. The pads preferably comprise or consist of cotton fibers and/or viscose fibers, wherein synthetic fibers, such as bicomponent fibers and/or polyester fibers, can preferably be added.

The pads are manufactured by usual web formation methods, such as carding, airlaying, and, in particular, by bonding methods, such as water jet needling and/or thermal and/or chemical binders.

Liquid is applied to the pads. This liquid can, for example, comprise an aqueous solution, an oil-in-water emulsion, or a water-in-oil emulsion. The liquid can, in particular, contain further components, such as care extracts, such as aloe vera, and/or scents/perfumes.

Further characteristics, details, and advantages of the invention result from the attached claims and from the drawings and description below of preferred embodiments of the inventive arrangement. For the characteristics stated above, below, and/or in the claims, protection is claimed irrespective of any dependency and in any combination. The drawing shows:

DESCRIPTION OF THE PREFERRED EMBODIMENT

Figure 1:
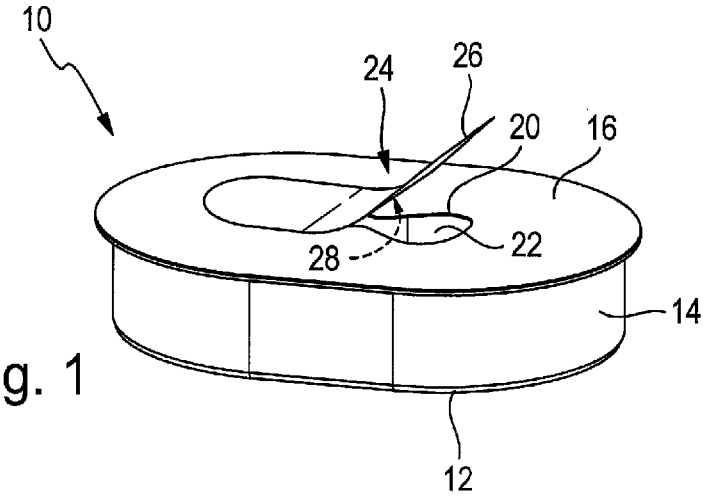
FIG. 1 A perspective view of an embodiment of a packaging container.
Figure 2:
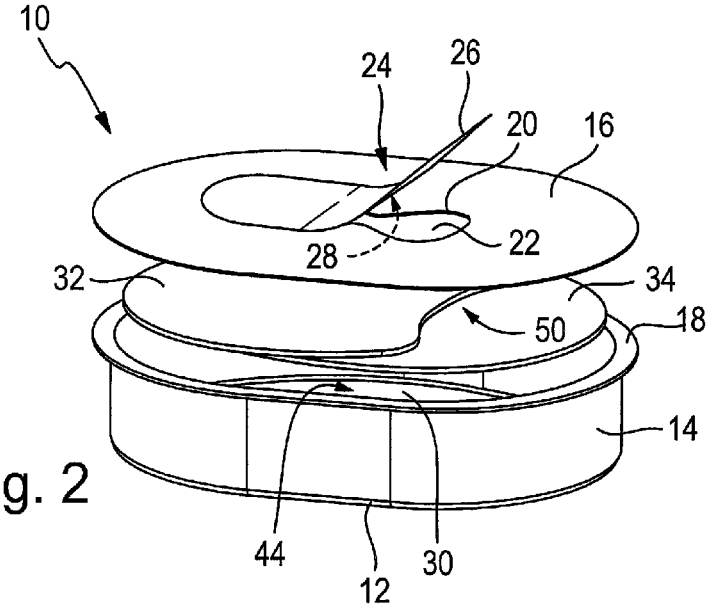
FIG. 2 An exploded view of an embodiment of an arrangement of a plurality of pads in a packaging container according to FIG. 1.

An embodiment of a packaging container is collectively designated with the reference number 10 in FIG. 1. The packaging container 10 has a packaging base 12 that is elliptical or, as shown in the drawing, comprising two semicircles and a central rectangular area. A sidewall 14 extends along the contour of the packaging base 12 and perpendicular thereto and has a height which corresponds to the useful height of the packaging container 10.

The packaging container 10 has a wall 16 on the cover side, which extends, in particular, parallel to the packaging base 12.

The wall 16 on the cover side has a slightly larger area than the packaging base 12, so that it can be attached to the upper side of a mounting edge 18 protruding outward from the side wall 14, in particular, using a permanent adhesive or welded connection.

The wall 16 on the cover side has a removal opening 20 preferably extending parallel to the packaging base 12, which is used to form an access to the interior of the packaging container 10. The removal opening 20 limits a removal opening area 22. The removal opening 20 can be detachably closed using a locking tab 24.

In a closed condition, the locking tab 24 completely overlaps the removal opening 20. The locking tab 24 has a gripping section 26 free of adhesive in a known way, by means of which the locking tab 24 can be lifted at least in sections from the upper part of the wall 16 on the cover side. The locking tab 24 has an adhesive coating 28 along the underside of an edge overlapping the removal opening 20 to ensure that the removal opening 20 can be reclosed.

Figure 5:
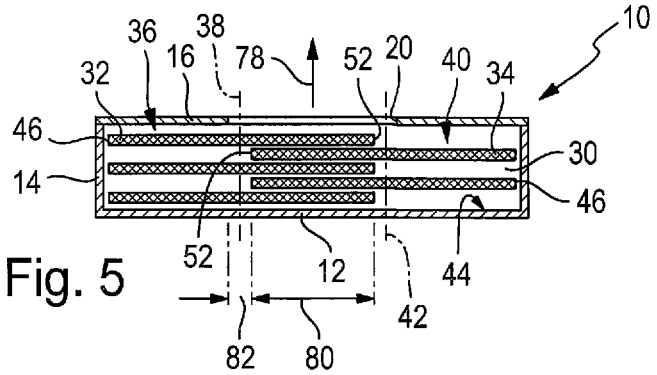
FIG. 5 A side view of the arrangement according to FIG. 4 along a section plane designated V-V in FIG. 4.
Figure 6:
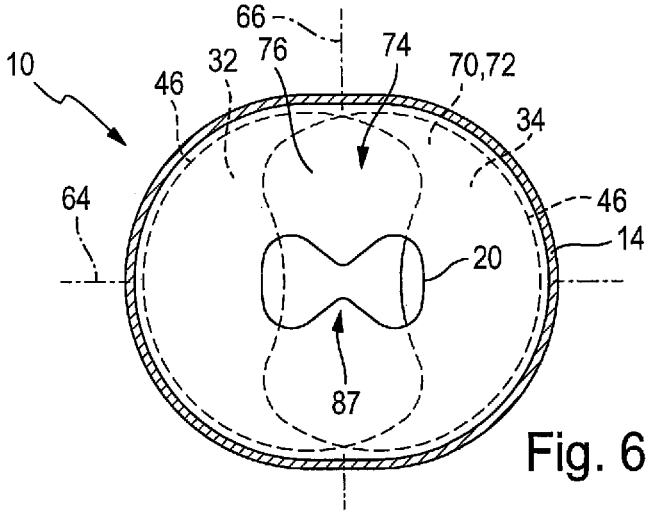
FIG. 6 A view corresponding to FIG. 4 of a further embodiment of a packaging container with a removal opening reduced in size.

An interior 30 of the packaging container 10 is filled with pads 32, 34 disposed in an alternating overlapping manner. In the description below, the pads 32 are allocated to a first stack 36 with a first stack axis 38 (cf. FIG. 5). The pads 34 are allocated to a second stack 40 with a second stack axis 42. The stack axes 38 and 42 extend perpendicularly with respect to the extension planes of the pads 32 and 34. The stack axes 38 and 32 are parallel with to another.

The stack axes 38 and 42 extend, in particular, perpendicularly with respect to a basic area 44 of the packaging container 10. The basic area 44 is that area of the packaging base 12 that is limited by the inner side of the side wall 14. This basic area is therefore available for setting up the stacks 36 and 40.

The pads 32, 34 have an edge 46 on the circumference side that is, in particular, free of folds.

Figure 7:
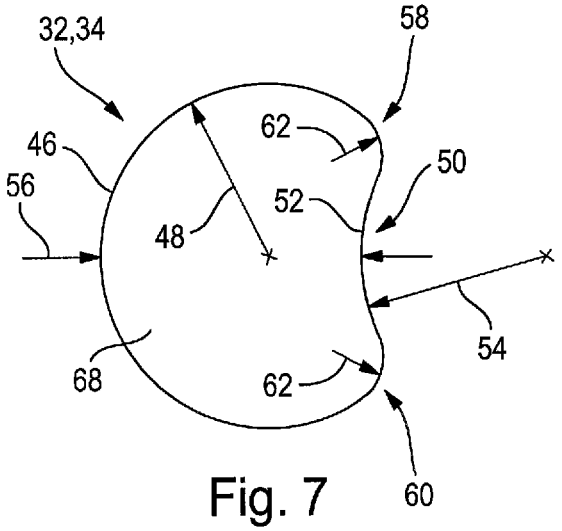
FIG. 7 A plan view of an embodiment of a pad for use in the arrangement according to FIGS. 2 to 6.

The basic shape of the pads 32, 34 is, in particular, a circular shape (cf. FIG. 7). This circular shape has, for example, a radius 48 of 23 to 40 mm, in particular, a radius 48 of 35 mm. Deviating from this basic shape, the pads 32, 34 have a material cut-out 50 at the edge that is limited by a border 52. The border 52 is part of the profile of the edge 46, but deviates with this border 52 from the basic shape of the edge 46. The border 52 can, for example, be constituted in the shape of a recess, wherein the profile of the border 52 limiting the recess is defined by a radius 54. The radius 54 can have the values stated above in respect of the radius 48. In particular, the radius 54 can be equal to the radius 48.

Due to the material cut-out 50 at the edge, the pads 32, 34 have a minimum diameter 56, which, for example, is between 25 mm and 73 mm, preferably, between 40 mm and 58 mm, further, in particular, between 40 and 55 mm.

The border 52 transitions, with respect to the direction of the minimum diameter 56, into the basic shape of the edge 46 at transitions 58, 60 disposed opposite each other, in particular, free of folds. A radius 62 in a transition region 58, 60 is preferably smaller than the radius 48 defining the basic shape of the pad 32, 34. In particular, the radius 62 is equal to 10 mm.

Figure 4:
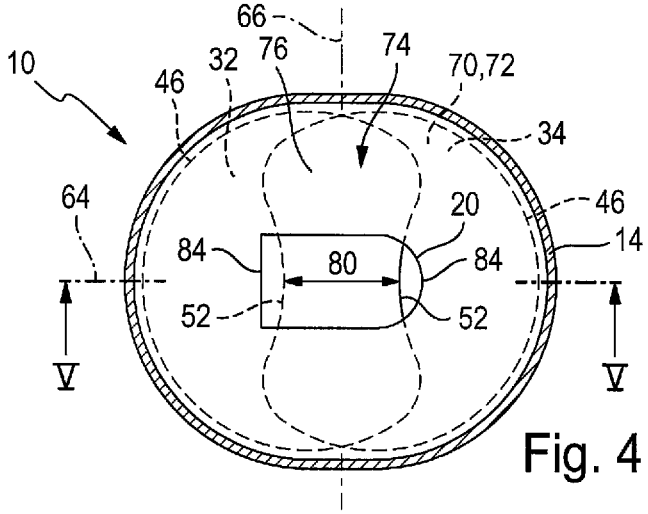
FIG. 4 A plan view of the arrangement according to FIG. 2 after removal of a locking tab.

The pads 32, 34 are, in respect of each of their stack axes 38, 42, oriented in opposite directions to each other. Thus, the material cut-outs 50 at the edge of the pads 32 of the first stack 36 face in the direction of the second stack 42, and the material cut-outs 50 at the edge of the pads 34 of the second stack 34 face in the direction of the first stack 36. In particular, the pads 32 and 34 are disposed mirror symmetrically or at least substantially mirror symmetrically with respect to the first plane of symmetry 64 (cf. FIG. 4) of the packaging container 10, which is defined by the greatest distance of mutually opposite sections of the sidewall 14 and/or relative to a second plane of symmetry 66 perpendicular to the first plane of symmetry 64, which is defined by the smallest distance of mutually opposite sections of the sidewall 14.

The pads 32, 34 have a pad area 68 enclosed by the edge 46 including border 52. The pads 32, 34 of different stacks 36, 40 jointly limit a total area 70, which has no discontinuities for the embodiments shown in FIGS. 2 to 6 and is therefore identical with a stack area 72. The pad areas 68 of the pads 32, 34 of different stacks 36, 40 overlap in a partial region 74, that is shown hatched in FIG. 3. The partial region 74 has an overlap area 76. The partial region 74 with the overlap area 76 is also limited by the borders 52 of the material cut-outs 50.

At least parts of the borders 52 are disposed in such a way relative to the removal opening 20 that, in respect of a removal direction 78 (cf. FIG. 5), they are accessible through the removal opening 20. For example, a minimum distance 80 of the borders 52 of the material cut-outs 50 at the edge of different pads 32, 34 is between 5 and 35 mm, in particular, 25 mm.

A length measured parallel to this (without reference number) of the removal opening 20 is, for example, 20 to 50 mm, in particular, 35 mm.

A distance 82 of a border 52 of a material cut-out 50 to a closest limit 84 of the removal opening 20 is preferably no more than 16 mm and, in particular, at least 5 mm.

Figure 3:
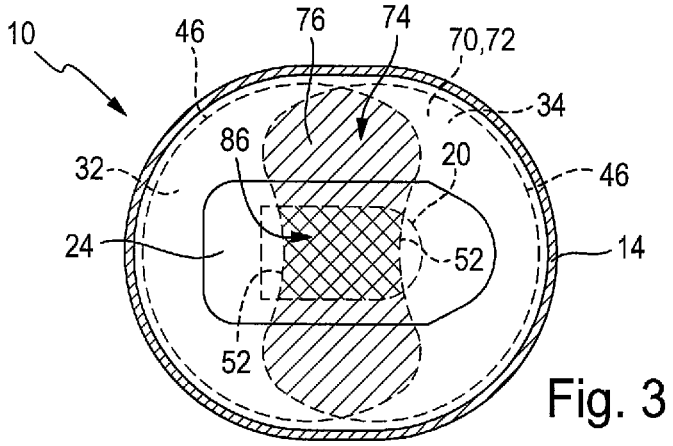
FIG. 3 A plan view of the arrangement according to FIG. 2.

The profile of the removal opening 20 is coordinated with the partial region 74 in which the pads 32, 34 overlap, in such a way that only a partial section area 86 (that is, only a proportion of the overlap area 76, this proportion is cross-hatched in FIG. 3) is accessible through the removal opening 20. The removal opening 20 can have a substantially elongated shape, for example, a rectangular shape, or an elongated hole shape, or a shape that combines these shapes (cf. FIGS. 3 and 4).

To further reduce the size of the removal opening area 22 of the removal opening 20, the removal opening 20 can have a necked profile in a region 87. The neck 87 is preferably constituted symmetrically with respect to at least one of the axes of symmetry 64, 66.

To remove a pad 32, 34 from the packaging container 10, the locking tab 24 is lifted from the removal opening 20 so that the removal opening area 22 is exposed. After this, a border 52 of the material cut-out 50 at the edge of a first pad 32 can be gripped with a finger, which can be introduced in the region of the removal opening 20 between the border 52 of the material cut-out 50 at the edge and a border 84 of the removal opening 20. This is done while resting a fingertip on a top side of a second pad 34. Removal of the first pad 32 through the removal opening 20 entails deformation of the pad 32. After removal of the first pad 32 has been completed, a finger can be introduced into the removal opening 22 and grip at the border 52 of the material cut-out 50 at the edge of the pad 34, resting on the top side of the next "first" pad 32, and, deforming the second pad 34, remove the second pad 34 from the interior 30 through the removal opening 20.

Figure 8:
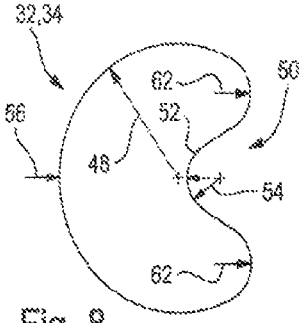
FIG. 8 A plan view of a further embodiment of a pad.

In the embodiment shown in FIG. 8 of a pad 32, 34, the material cut-out 50 at the edge is more strongly pronounced than the material cut-out 50 at the edge of the pads 32, 34 according to FIG. 7. This is achieved by locating the material cut-out at the edge further toward the center of the pad 32, 34 and reducing the radius of curvature 54 in this region. This results in a minimum diameter 56 of the pad 32, 34 according to FIG. 8, for example, that is only slightly larger than the radius 48, which is defined by the basic shape of the pad 32, 34 according to FIG. 8.

Figure 9:
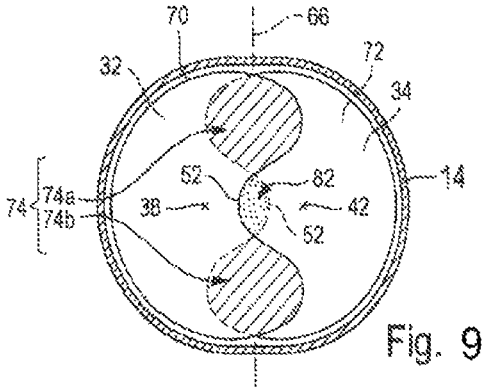
FIG. 9 A plan view of a further embodiment of an arrangement of a plurality of pads according to FIG. 8 in a packaging container.

Displacement of the material cut-out 50 at the edge radially inward, while retaining the packaging size of the packaging container 10 according to FIGS. 2 to 6 with a corresponding distance of the stack axes 38, 32 (cf. FIG. 9), forms a free area, which is shown dotted in FIG. 9. The free area 88 is limited at least by part of the limits 52 of the material cut-outs 50 at the edge. Neither material of the first pad 32 nor material of the second pad 34 is disposed in the region of the free area 88. The stack area 72 of the arrangement according to FIGS. 9 to 11 corresponds to the total area 70 jointly limited by the pads 32, 34, minus the free area 88.

The dimensions and positioning of the removal opening 20 and the free area 88 are coordinated with each other in such a way that an access free area 90 accessible through the removal opening 20 is equal to the total free area 88. (In FIG. 10, the access free area 90 is shown cross-hatched.)

If the removal opening 20 is further reduced in size, for example, having a neck 87 (cf. FIG. 11), only part of the free area 88 can, for example, be exposed by the removal opening 20, with the consequence that the access free area 90 is smaller than the free area 88.

Figure 10:
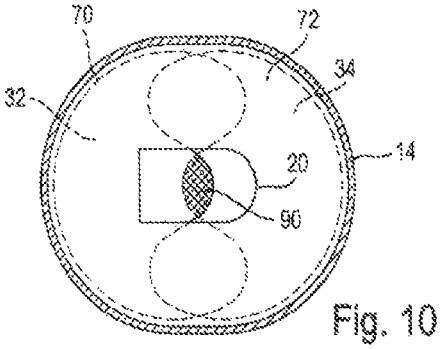
FIG. 10 A plan view corresponding to FIG. 4 of the arrangement according to FIG. 9.
Figure 11:
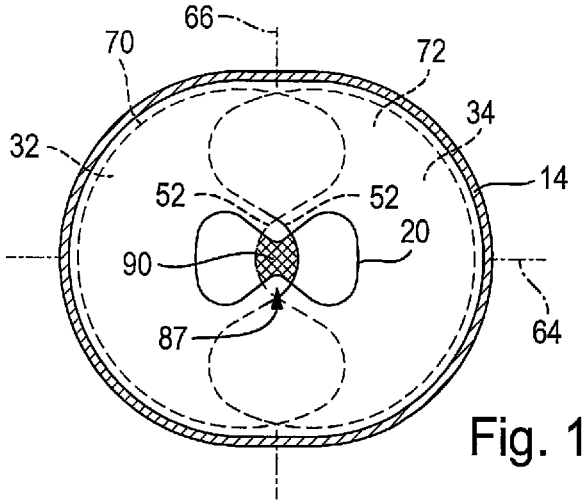
FIG. 11 A plan view corresponding to FIG. 10 of a further embodiment of a packaging container with a removal opening reduced in size.

In the arrangement shown in FIGS. 9 to 11, the partial region 74, in which the pads 32, 34 of different stacks overlap, is divided into two and surrounds a first overlap section 74*a* and a second overlap section 74*b*. The free area 88 is, in particular, with reference to a plane of symmetry 66 between the sections 74*a* and 74*b*, disposed such that the border 52 of the material cut-outs 50 at the edge, limit both the free area 88 and the sections 74*a* and 74*b* of the partial region 74.

Figure 12:
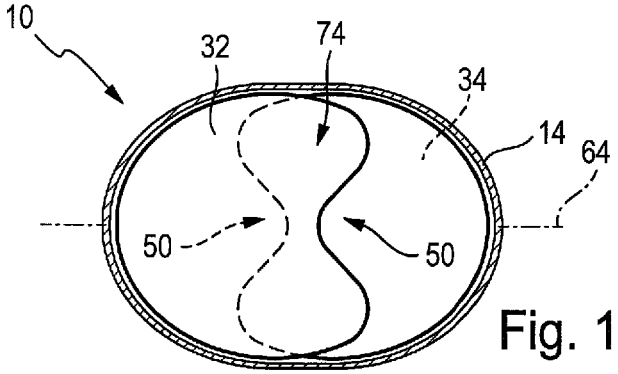
FIGS. 12-14 Plan views corresponding to FIG. 9 of further embodiments of arrangements of a plurality of pads in a packaging container.

In an embodiment shown in FIG. 12, pads 32, 34 are provided, which, with reference to a first plane of symmetry 64 of the packaging container 10, are constituted as an elongated ellipse. The partial region 74 arising by proportional overlapping of the pad 32 has the shape of an hourglass.

Figure 13:
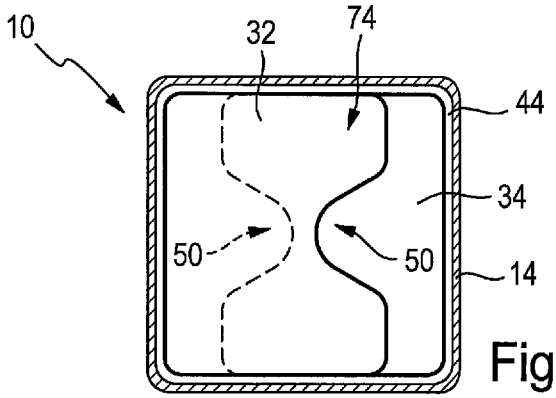

FIG. 13 shows an embodiment with a packaging container 10, which has a substantially square basic area 44 for disposing pads 32, 34, which have a rectangular basic shape. Due to the shape of the material cut-outs 50 at the edge, a substantially hourglass-shaped partial region 74 arises, in which the pads 32, 34 overlap.

Figure 14:
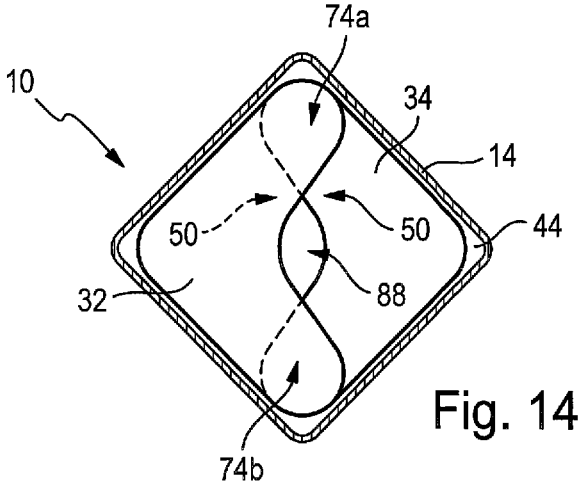

If the material cut-outs 50 at the edge are sufficiently pronounced, it is also possible for the pads 32, 34 of different stacks to overlap in multiple sections 74*a*, 74*b* if the basic area 44 is substantially square. The sections 74*a*, 74*b* jointly form the partial region 74. A free area 88 is constituted between the partial regions 74*a*, 74*b* (cf. FIG. 14).

Figure 15:
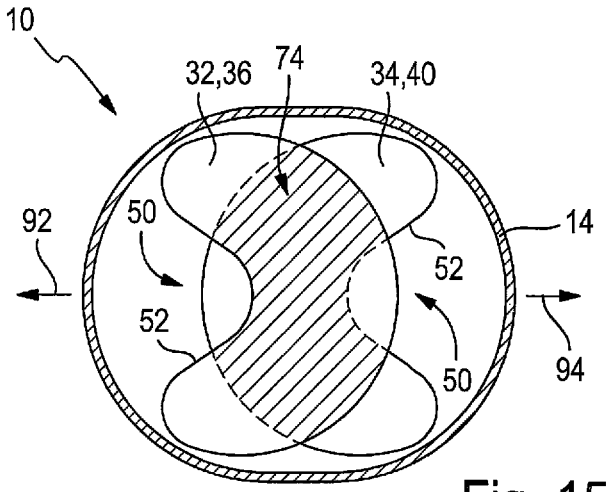
FIG. 15 A plan view of a further embodiment of an arrangement of a plurality of pads in a packaging container.

FIG. 15 shows an embodiment in which the material cut-outs 50 of the pads 32, 34 of different stacks 36, 40 each face a periphery of the packaging container 10. The material cut-out 50 of the first pad 32 faces in a direction 92 toward the periphery of the packaging container 10; the material cut-out 50 of the second pad 34 faces in the direction 94 toward the periphery of the packaging container 10; the directions 92 and 94 are opposite to each other.

We claim:

1. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, wherein the packaging container has a basic area for setting up said first and second stacks, wherein said pads have a pad area enclosed by an edge of a pad, and a ratio of said basic area to said pad area is between 1.30 and 2.00 or between 1.50 and 1.80.

2. The arrangement of claim 1, wherein each pad has precisely one material cut-out at an edge serving as a gripping aid.

3. The arrangement of claim 1, wherein a total area jointly limited by two overlapping pads of different stacks is closed.

4. The arrangement of claim 1, wherein a total area jointly limited by two overlapping pads of different stacks has a free area, which is limited by at least part of borders of said material cut-outs at an edge of said two overlapping pads.

5. The arrangement of claim 1, further comprising the packaging container, said packaging container having a wall or a wall on a cover side, said wall having a removal opening with a removal opening area for removal of one pad at a time.

6. The arrangement of claim 5, wherein said removal opening is detachably lockable.

7. The arrangement of claim 5, wherein said removal opening is positioned and dimensioned such that only accessible through said removal opening are: a partial section of said partial region in which said pads of said first and second stacks overlap; a material cut-out of a pad of said first stack or a part thereof; after removal of such a pad of said first stack, a material cut-out of a pad of said second stack or part thereof.

8. The arrangement of claim 5, wherein a total area jointly limited by two overlapping pads of different stacks has a free area, which is limited by at least part of a border of said material cut-outs at an edge of said two pads, and the removal opening is positioned and dimensioned such that only accessible through said removal opening are: said free area or part of said free area; a material cut-out of a pad of said first stack or parts thereof; after removal of such a pad of said first stack, a material cut-out of a pad of said second stack or part thereof.

9. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, wherein two overlapping pads of different stacks jointly occupy a stack area, wherein each of said two pads has a pad area enclosed by an edge of said pad, wherein a ratio of said stack area to said pad area is between 1.10 and 1.80 or between 1.20 and 1.70.

10. The arrangement of claim 9, further comprising the packaging container, said packaging container having a wall or a wall on a cover side, said wall having a removal opening with a removal opening area for removal of one pad at a time.

11. The arrangement of claim 10, wherein said removal opening is detachably lockable.

12. The arrangement of claim 10, wherein said removal opening is positioned and dimensioned such that only accessible through said removal opening are: a partial section of said partial region in which said pads of said first and second stacks overlap; a material cut-out of a pad of said first stack or a part thereof; after removal of such a pad of said first stack, a material cut-out of a pad of said second stack or part thereof.

13. The arrangement of claim 10, wherein a total area jointly limited by two overlapping pads of different stacks has a free area, which is limited by at least part of a border of said material cut-outs at an edge of said two pads, and the removal opening is positioned and dimensioned such that only accessible through said removal opening are: said free area or part of said free area; a material cut-out of a pad of said first stack or parts thereof; after removal of such a pad of said first stack, a material cut-out of a pad of said second stack or part thereof.

14. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, wherein said partial region in which said pads of said first and second stacks overlap, has an overlap area, wherein each pad has a pad area enclosed by an edge of said pad, and a ratio of overlap area to pad area is between 0.25 and 0.90, between 0.28 and 0.83 or between 0.40 and 0.67.

15. The arrangement of claim 14, further comprising the packaging container, said packaging container having a wall or a wall on a cover side, said wall having a removal opening with a removal opening area for removal of one pad at a time.

16. The arrangement of claim 15, wherein said removal opening is detachably lockable.

17. The arrangement of claim 15, wherein said removal opening is positioned and dimensioned such that only accessible through said removal opening are: a partial section of said partial region in which said pads of said first and second stacks overlap; a material cut-out of a pad of said first stack or a part thereof; after removal of such a pad of said first stack, a material cut-out of a pad of said second stack or part thereof.

18. The arrangement of claim 15, wherein a total area jointly limited by two overlapping pads of different stacks has a free area, which is limited by at least part of a border of said material cut-outs at an edge of said two pads, and the removal opening is positioned and dimensioned such that only accessible through said removal opening are: said free area or part of said free area; a material cut-out of a pad of said first stack or parts thereof; after removal of such a pad of said first stack, a material cut-out of a pad of said second stack or part thereof.

19. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, wherein said partial region in which said pads of said first and second stacks overlap, has an overlap area, wherein the packaging container has a basic area for setting up said first and second stacks, and a ratio of overlap area to basic area is between 0.12 and 0.83 or between 0.16 and 0.50.

20. The arrangement of claim 19, further comprising the packaging container, said packaging container having a wall or a wall on a cover side, said wall having a removal opening with a removal opening area for removal of one pad at a time.

21. The arrangement of claim 20, wherein said removal opening is detachably lockable.

22. The arrangement of claim 20, wherein said removal opening is positioned and dimensioned such that only accessible through said removal opening are: a partial section of said partial region in which said pads of said first and second stacks overlap; a material cut-out of a pad of said first stack or a part thereof; after removal of such a pad of said first stack, a material cut-out of a pad of said second stack or part thereof.

23. The arrangement of claim 20, wherein a total area jointly limited by two overlapping pads of different stacks has a free area, which is limited by at least part of a border of said material cut-outs at an edge of said two pads, and the removal opening is positioned and dimensioned such that only accessible through said removal opening are: said free area or part of said free area; a material cut-out of a pad of said first stack or parts thereof; after removal of such a pad of said first stack, a material cut-out of a pad of said second stack or part thereof.

24. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, further comprising the packaging container, said packaging container having a wall or a wall on a cover side, said wall having a removal opening with a removal opening area for removal of one pad at a time, wherein the packaging container has a basic area for setting up said first and said second stack, and a ratio of removal opening area to basic area is between 0.06 and 0.20, between 0.10 and 0.18 or between 0.10 and 0.16.

25. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, further comprising the packaging container, said packaging container having a wall or a wall on a cover side, said wall having a removal opening with a removal opening area for removal of one pad at a time, wherein said removal opening is positioned and dimensioned such that only accessible through said removal opening are: a partial section of said partial region in which said pads of said first and second stacks overlap; a material cut-out of a pad of said first stack or a part thereof; after removal of such a pad of said first stack, a material cut-out of a pad of said second stack or part thereof, wherein said partial section has a partial section area and a ratio of partial section area to removal opening area is between 0.12 and 0.90, between 0.20 and 0.90 or between 0.33 and 0.90.

26. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, further comprising the packaging container, said packaging container having a wall or a wall on a cover side, said wall having a removal opening with a removal opening area for removal of one pad at a time, wherein a total area jointly limited by two overlapping pads of different stacks has a free area, which is limited by at least part of a border of said material cut-outs at an edge of said two pads, and the removal opening is positioned and dimensioned such that only accessible through said removal opening are: said free area or part of said free area; a material cut-out of a pad of said first stack or parts thereof; after removal of such a pad of said first stack, a material cut-out of a pad of said second stack or part thereof, wherein said free area accessible through said removal opening or part of said free area accessible through said removal opening has an access free area, and a ratio of access free area to removal opening area is between 0.16 and 0.64.

27. An arrangement of a plurality of moist pads in a packaging container for dispensing to an end user, the arrangement comprising:

a first stack of pads; and a second stack of pads, wherein pads of said first and second stacks overlap in a partial region in such a manner that a pad of said second stack protrudes into said partial region between two pads of said first stack, wherein each pad of said first stack and each pad of said second stack has a material cut-out at an edge in order to form a gripping aid, wherein said pads of said first stack and said pads of said second stack are each oriented in such a manner that, at least in portions, said material cut-outs of said pads of said first stack and said material cut-outs of said pads of said second stack jointly define said partial region, further comprising the packaging container, said packaging container having a wall or a wall on a cover side, said wall having a removal opening with a removal opening area for removal of one pad at a time, wherein a distance, measured perpendicularly to a removal direction, of a border of said removal opening and a nearest positioned border of said material cut-out at an edge of a pad is between 5 mm and 16 mm, between 5 mm and 12 mm or between 5 mm and 8 mm.

* * * * *